US007547864B2

(12) United States Patent
Beausse

(10) Patent No.: US 7,547,864 B2
(45) Date of Patent: Jun. 16, 2009

(54) MICROWAVE OVEN HAVING PLURAL MAGNETRONS WITH COOLING AIR FLOW

(75) Inventor: Gerard Beausse, Charenton (FR)

(73) Assignee: Premark FEG L.L.C., Wilmington, DE (US)

( * ) Notice: Subject to any disclaimer, the term of this patent is extended or adjusted under 35 U.S.C. 154(b) by 5 days.

(21) Appl. No.: 11/911,730

(22) PCT Filed: Apr. 18, 2006

(86) PCT No.: PCT/US2006/014451

§ 371 (c)(1),
(2), (4) Date: Oct. 17, 2007

(87) PCT Pub. No.: WO2006/115883

PCT Pub. Date: Nov. 2, 2006

(65) Prior Publication Data

US 2008/0185378 A1 Aug. 7, 2008

(30) Foreign Application Priority Data

Apr. 22, 2005 (FR) ..... 05 04047

(51) Int. Cl.
*H05B 6/64* (2006.01)

(52) U.S. Cl. ..... 219/757; 219/756

(58) Field of Classification Search ..... 219/756, 219/757, 761; 126/21 A, 21 R, 299 R, 299 D
See application file for complete search history.

(56) References Cited

U.S. PATENT DOCUMENTS 4,896,010 A * 1/1990 O'Connor et al. ..... 219/757
6,923,715 B2 * 8/2005 Kreuzer et al. ..... 126/299 F
2002/0074330 A1 * 6/2002 Kim ..... 219/757
2004/0094541 A1 5/2004 Lee
2004/0149751 A1 8/2004 Lee

FOREIGN PATENT DOCUMENTS

| | | | |
|---|---|---|---|
| CA | 1190605 | | 7/1985 |
| EP | 69105 | * | 1/1983 |
| JP | 5-322187 | * | 12/1993 |
| WO | 2004/032570 | | 4/2004 |

OTHER PUBLICATIONS

International Preliminary Report on Patentability issued regarding International Application No. PCT/US2006/014451 (Oct. 23, 2007).
International Search Report issued by the International Searching Authority regarding PCT/US2006/014451 (Aug. 24, 2006).

* cited by examiner

*Primary Examiner*—Quang T Van
(74) *Attorney, Agent, or Firm*—Thompson Hine LLP

(57) ABSTRACT

The invention relates to a microwave oven including a food-cooking enclosure, the electromagnetic energy of which is supplied by a set of two to four magnetrons (5, 6, 7) mounted on an enclosure wall, the magnetrons communicating with waveguides (55, 65, 75) which are in communication with the oven enclosure. The magnetrons are individually air-cooled and the air is then discharged to the outside via a discharge conduit.

The invention is characterised in that the discharge conduits open out into a common calming chamber before discharge to the outside.

7 Claims, 2 Drawing Sheets

MICROWAVE OVEN HAVING PLURAL MAGNETRONS WITH COOLING AIR FLOW

The present invention concerns microwave ovens and in particular relates to so-called large-scale catering ovens.

Microwave ovens are formed by an enclosure for cooking or heating foodstuffs consisting of a generally parallelepipedic cavity open on one face. A door is mounted on hinges along one wall and pivots between an open position allowing access to the cavity and a closed position during operation of the oven. An ultrahigh-frequency wave-generating means transforms the electrical energy into electromagnetic energy by which the foodstuffs are heated.

There are large-scale professional catering ovens having a relatively large capacity, greater than 150 liters, which are of the combination type. They combine with microwave heating at least one convection or steam heating system. Convection heating is carried out by means of a gas burner or one or more electrical resistors. Steam heating includes, for example, inside the cavity at least one fan associated with an electrical resistor or a gas burner with steam production. According to another example the steam is produced in an external boiler.

For large-capacity ovens in particular, the means for production of ultrahigh-frequency energy is composed of several magnetrons arranged on one side of the enclosure, on the outside.

Patent application WO 2004/032570 relates to a microwave oven equipped with two to four magnetrons. The waveguides of the latter communicate with a microwave agitation box. The box is of parallelepipedic shape with four walls perpendicular to the oven wall on which the magnetrons are mounted. The waveguides each open out into one of said four walls. One of the faces of the box is common with the oven wall and made of a microwave-permeable material such as mica. A rotary phase modulator is mounted on the rear face parallel to the latter. This arrangement makes it possible, when the magnetrons are in operation and the modulator driven at an elevated speed of rotation, to generate a wide range of simultaneous frequencies in the cooking enclosure.

Figure 1:
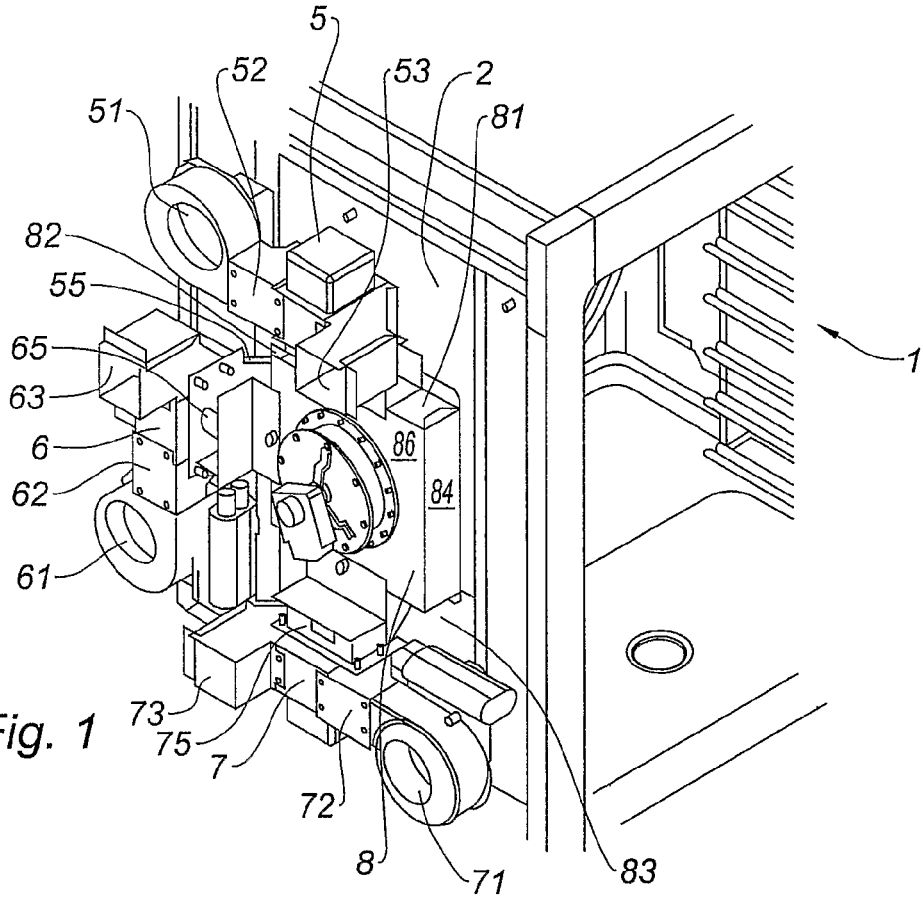

In FIG. 1 is shown a perspective view of the outer wall of the oven on which the magnetrons are mounted.

The envelope of the oven 1 includes a vertical wall 2 to the left of the opening giving access to the foodstuff-cooking enclosure which can be seen partially. On this wall 2, on the outside, are placed the magnetrons (5, 6 and 7) constituting the electromagnetic energy source. According to this embodiment, the energy source consists of three magnetrons. There may be two to four of them. The magnetrons are each in communication with a waveguide (55, 65 and 75) respectively. The waveguides open out into a wave agitation box 8 as described in patent application WO 2004/032570. The box 8 includes four walls (81, 82, 83 and 84) perpendicular to the oven wall 2, and a rear back wall 86 parallel to the latter. The waves emitted by the magnetrons are guided in waveguides, agitated in the box 8 by a rotary phase modulator of which only the drive motor can be seen in the figure, and reflected in the oven across a wave-permeable glass panel covering the wave box 8.

The magnetrons are each provided with an individual cooling device including a fan (51, 61 and 71) for supply of air and an air discharge conduit (53, 63 and 73). The radial fans each supply with air a conduit (52, 62, 72). The air cools the cooling fins at the level of the magnetrons, not visible, then is discharged via the conduits (53, 63, 73) arranged perpendicularly to the oven wall 2.

The present invention aims to ensure optimum discharge of the air via the conduits (53, 63, 73). This air must be discharged efficiently so that operation of the magnetrons is not impaired, but also must disturb as little as possible the immediate environment of the oven in the kitchen in which it is installed.

According to the invention, the microwave oven includes a food-cooking enclosure, the electromagnetic energy of which is supplied by a set of two to four magnetrons mounted on an enclosure wall, the magnetrons communicating with waveguides which are in communication with the oven enclosure, the magnetrons being individually air-cooled, the air being then discharged to the outside via a discharge conduit. It is characterised in that the air discharge conduits open out into a common calming chamber before discharge to the outside.

Owing to the arrangement of the invention and the interposition of a chamber in which the flows of outgoing hot air are equalised and their speed reduced, in particular any pollution they might cause is eliminated.

Figure 2:
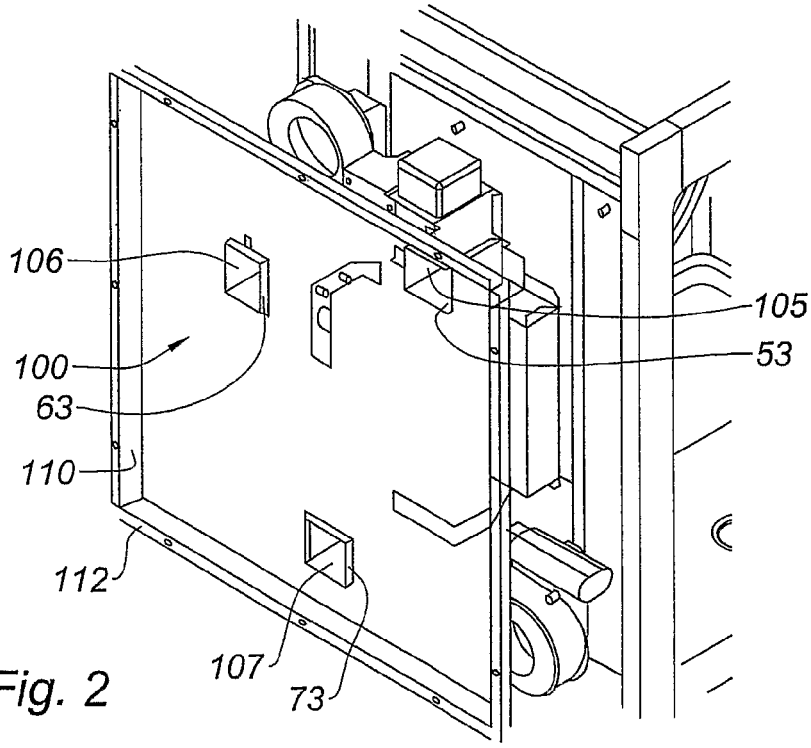
Figure 3:
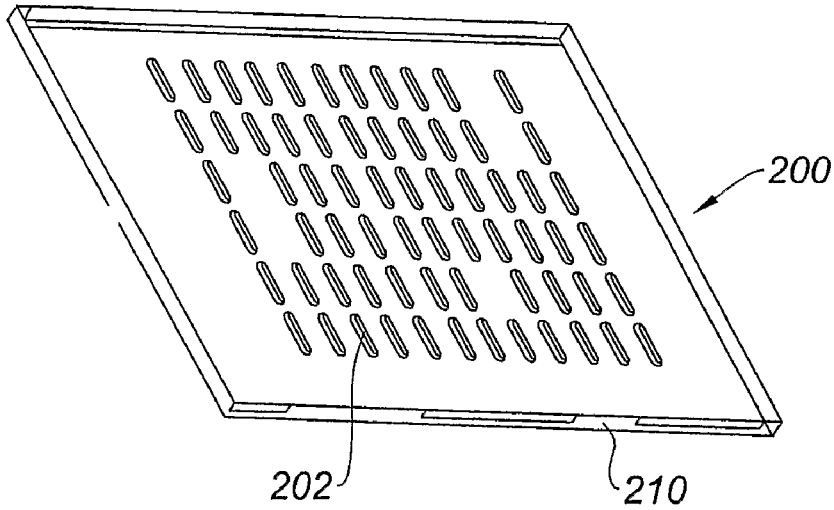
Figure 4:
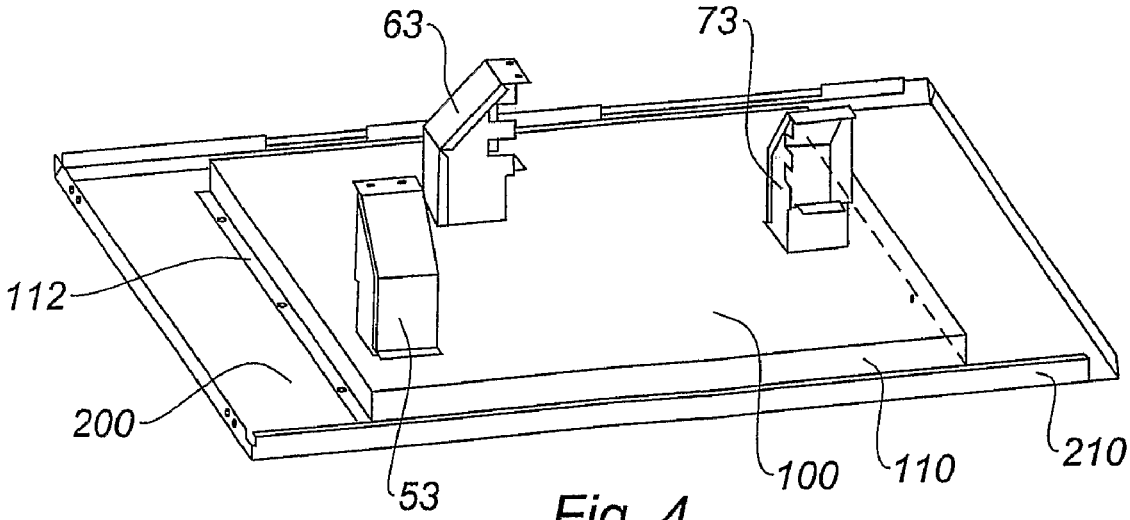

FIG. 1 is a partial view from the outside, in perspective, of a microwave oven of the type of the invention without the calming chamber, FIG. 2 is the view shown in FIG. 1 showing the installation of a plate for the arrangement of a calming chamber, FIG. 3 shows the hood which is placed on the plate of FIG. 2 to form the calming chamber, FIG. 4 shows the plate and the hood forming between them a calming chamber.

FIG. 2 shows the oven seen from the same angle as in FIG. 1. A plate 100, made of sheet metal, is mounted in a frame integral with the wall 2. This plate is solid (the components under the metal sheet are shown by transparency to facilitate understanding) with the exception of three openings (105, 106 and 107) made opposite the respective discharge conduits (53, 63 and 73) of the three magnetrons (5, 6 and 7). These openings allow contact-free sliding of the conduits. Here, the conduits and the openings made in the metal sheet are of square section. They could be a different shape. The metal sheet has a rim 110 perpendicular to its plane with a fixing clamp 112 parallel to its plan. The height of the rim 110 is determined according to the calming chamber to be provided. The volume of the chamber depends on the air flow rate provided by the air conduits.

FIG. 4 shows the metal sheet 100 fixed to an apertured hood 200 by the clamps 112. Together they constitute the calming chamber 100-200. The hood 200 constitutes an outer wall of the oven. It includes itself means 210 on the edges for fixing it to the oven walls. The hood 200 is shown on its own in FIG. 3.

This hood includes a large number of louvres 202 which can be seen by transparency in FIG. 4. The louvres are formed by stamping the metal sheet so that the direction of the air escaping therefrom is oriented downwards preferably. In FIG. 4 can also be seen on their own the air discharge conduits (53, 63, 73) for cooling the magnetrons. It is established that the hood, in relation to the discharge conduits, has no louvre. The objective is to prevent any splashes of water on the hood 200 from passing into the discharge conduits. It is further observed that the conduits open out into the calming chamber thus formed, remaining at a distance from the hood.

During operation of the oven, the fans draw in air from the outside via openings formed in the rear hood of the oven, not shown. This air cools the cooling fins of the magnetrons then is discharged via the discharge conduits (53, 63, 73). The air coming from these conduits passes into the chamber 100-200 formed between the plate and the hood of which the volume is sufficient for the air to expand and its speed to be reduced.

The air passes to the outside via the louvres 202. The total section for passage through the louvres is greater than that of the three discharge conduits.

The invention claimed is:

1. Microwave oven including:

a food-cooking enclosure, electromagnetic energy of which is supplied by a set of two to four magnetrons mounted on an enclosure wall, the magnetrons communicating with waveguides which are in communication with the enclosure, the magnetrons being individually air-cooled, the air being then discharged to the outside via a respective discharge conduit, wherein the air discharge conduits open out into a common calming chamber before discharge to the outside of the oven, the common calming chamber spaced from the enclosure and the discharge conduits extending perpendicularly away from the enclosure wall and away from the enclosure.

2. Oven according to claim 1, wherein the calming chamber is formed between a plate and an apertured hood, both being parallel to the enclosure wall.

3. Oven according to claim 2 of which the discharge conduits are mounted in sliding relationship relative to the plate.

4. Oven according to claim 2 of which the hood is a metal sheet provided with downwardly oriented louvres.

5. Oven according to claim 4 of which the hood comprises no louvre in positions opposite outlet openings of the discharge conduits into the calming chamber.

6. A microwave oven, the oven comprising:

an enclosure;

a plurality of magnetrons mounted on a wall of the enclosure, wherein the magnetrons are in communication with the enclosure using waveguides; and a plurality of discharge conduits that open out into a common calming chamber before discharge to the outside of the oven;

wherein each magnetron is individually air-cooled, the cooling air from each magnetron being then discharged to the calming chamber via one of the discharge conduits;

wherein the calming chamber is spaced from the enclosure and each magnetron is positioned between the enclosure and the calming chamber.

7. The microwave oven of claim 6 wherein the calming chamber is formed between a plate and an apertured hood, both being parallel to the wall of the enclosure, the calming chamber is spaced from the enclosure and each magnetron is positioned between wall of the enclosure and the plate.

* * * * *